US006470695B2

(12) United States Patent
Gong

(10) Patent No.: US 6,470,695 B2
(45) Date of Patent: Oct. 29, 2002

(54) REFRIGERANT GAUGE MANIFOLD WITH BUILT-IN CHARGING CALCULATOR

(75) Inventor: Ying Gong, Fort Smith, AR (US)

(73) Assignee: Rheem Manufacturing Company, New York, NY (US)

( * ) Notice: Subject to any disclaimer, the term of this patent is extended or adjusted under 35 U.S.C. 154(b) by 25 days.

(21) Appl. No.: 09/789,158

(22) Filed: Feb. 20, 2001

(65) Prior Publication Data

US 2002/0112490 A1 Aug. 22, 2002

(51) Int. Cl.[7] ..... F25B 45/00

(52) U.S. Cl. ..... 62/129; 62/77; 62/149; 62/292

(58) Field of Search ..... 62/125, 126, 127, 62/129, 130, 77, 149, 292

(56) References Cited

U.S. PATENT DOCUMENTS

| | | | | |
|---|---|---|---|---|
| 3,118,463 A | | 1/1964 | Lacart | 137/343 |
| 3,686,954 A | | 8/1972 | Motl | 73/432 R |
| 4,106,306 A | | 8/1978 | Saunders | 62/149 |
| 4,114,448 A | * | 9/1978 | Merritt | 62/149 X |
| 4,285,206 A | * | 8/1981 | Koser | 62/149 X |
| 5,156,012 A | | 10/1992 | Kuribara et al. | 62/129 |
| 5,209,400 A | | 5/1993 | Winslow et al. | 236/94 |
| 5,311,745 A | | 5/1994 | Lockhart et al. | 62/127 |
| 5,317,903 A | | 6/1994 | McClelland et al. | 62/77 |
| 5,381,669 A | * | 1/1995 | Bahel et al. | 62/129 |
| 5,431,189 A | | 7/1995 | Jones | 137/625.42 |
| 5,715,692 A | | 2/1998 | Pappas | 62/129 |
| 5,860,286 A | | 1/1999 | Tulpule | 62/129 |
| 5,987,903 A | | 11/1999 | Bathla | 62/129 |

* cited by examiner

*Primary Examiner*—Harry B. Tanner
(74) *Attorney, Agent, or Firm*—Konneker & Smith, P.C.

(57) ABSTRACT

A gauge manifold is connectable to the suction and liquid lines of an air conditioning refrigerant circuit and has a built-in charge level calculator into which system manufacturing and capacity data is enterable. Charging data corresponding to the input data is stored within the calculator and automatically utilized in conjunction with ambient temperature and refrigerant pressure levels sensed by the calculator to generate a visual display indicating whether the circuit's refrigerant charge level is acceptable, high or low for the particular unit or system being checked. If the displayed charge level is high or low, the gauge manifold is additionally connected to a pressurized refrigerant canister or recycling drum and a valve portion of the manifold is operated to add or remove refrigerant to the circuit, via the gauge manifold, as necessary until the calculator display indicates that the circuit is properly charged.

15 Claims, 2 Drawing Sheets

REFRIGERANT GAUGE MANIFOLD WITH BUILT-IN CHARGING CALCULATOR

BACKGROUND OF THE INVENTION

The present invention generally relates to air conditioning apparatus and, in a preferred embodiment thereof, more particularly relates to a specially designed refrigerant gauge manifold having a built-in refrigerant charging calculator.

As is well known in the air conditioning industry, for an air conditioning system to properly perform at its designed-for capacity the charge level of its refrigerant circuit must be neither too high nor too low. It is accordingly desirable to periodically check the amount of refrigerant which the refrigerant circuit contains. In direct expansion type refrigerant circuits this is typically done by taking refrigerant pressure readings at service ports on the liquid and suction sides of the circuit, determining the ambient temperature adjacent the service ports, and comparing these ambient temperature and refrigerant pressure readings to data contained on a system charge chart which is provided by the manufacturer of the air conditioning system.

A charge chart of this type typically has outdoor ambient dry bulb temperature lines plotted on a liquid pressure vs. suction pressure graph. To check the system's refrigerant charge level, the service technician determines the outdoor ambient temperature, and the liquid and suction line pressures, and marks on the chart the point of intersection of the determined liquid and suction pressures. If this intersection point falls below the determined ambient dry bulb temperature line, the technician adds refrigerant to the circuit, and if the intersection point falls above the determined ambient dry bulb temperature line, the technician removes refrigerant from the circuit. The new liquid line/suction line pressure intersection point is then checked against the determined ambient temperature line, and the refrigerant addition or removal step is repeated until the pressure intersection point falls on the ambient pressure line on the charging chart. As an alternative to this charge chart in graph form, the manufacturer may provide this data in tabular form.

Several well known problems, limitations and disadvantages are typically associated with this conventional method of checking and adjusting the refrigerant charge level of an air conditioning system. For example, not every service technician has appropriate instruments, sensors and the like to efficiently carry out this process. Additionally, as conventionally carried out, this process is an iterative one which can be a time consuming and laborious one. Further, a given portion of the air conditioning system may have a number of independent circuits and associated charge charts. This presents the possibility that the technician could utilize the wrong chart, thereby providing a refrigerant circuit with an incorrect charge level. And, of course, the charging chart(s) initially provided by the manufacturer could be lost.

As can readily be seen from the foregoing, a need exists for an improved technique for measuring and adjusting the charge level of an air conditioning system refrigerant circuit that eliminates or at least substantially reduces the above-mentioned problems, limitations and disadvantages commonly associated with conventional techniques for performing these tasks. It is to this need that the present invention is directed.

SUMMARY OF THE INVENTION

In carrying out principles of the present invention, in accordance with a preferred embodiment thereof, apparatus is provided for determining and, if necessary, adjusting the charge level of an air conditioning system refrigerant circuit.

Representatively, the apparatus comprises a porting portion interconnectable between the circuit and a refrigerant vessel, the porting portion being operative to selectively transfer refrigerant in a variable direction between the circuit and the refrigerant vessel which may be, for example, a refrigerant charging canister or a refrigerant recovery drum. The apparatus further comprises a valve portion for operating the porting structure, and a sensing portion for sensing ambient temperature and circuit refrigerant pressure levels and responsively generating output signals.

The apparatus also comprises a calculator portion for storing identifying and charging data for a plurality of air conditioning systems, receiving the output signals and system identifying data input by an operator indicative of the circuit being tested, and responsively creating a display indicative of whether the circuit being tested is adequately charged, undercharged or overcharged, the display being automatically changeable in response to variation of at least one of the output signals caused by a flow of refrigerant into or out of the circuit via the refrigerant transfer port.

In a preferred embodiment of the present invention, the apparatus is a refrigerant gauge manifold with a built-in charging calculator, and may be easily and quickly used to both determine the sufficiency of the refrigerant charge in the circuit being tested, and to adjust the refrigerant charge, via the manifold, if necessary.

According to various features of the invention, in a preferred embodiment thereof, the porting portion includes a suction port communicatable with a suction line portion of the circuit, a liquid port communicatable with a liquid line portion of the circuit, and a refrigerant transfer port communicatable with a refrigerant canister or a refrigerant recovery drum. The valve portion representatively includes a first valve operative to selectively permit and preclude communication between the suction and refrigerant transfer ports, and a second valve operative to selectively permit and preclude communication between the liquid and refrigerant transfer ports.

The sensing portion is representatively operative to sense ambient dry bulb temperature and the liquid and suction line refrigerant pressures in the circuit, and illustratively includes a first pressure-to-electric transducer operatively coupled between the suction port and the calculator portion, and a second pressure-to-electric transducer operatively coupled between the liquid port and the calculator portion.

DETAILED DESCRIPTION

Figure 1:
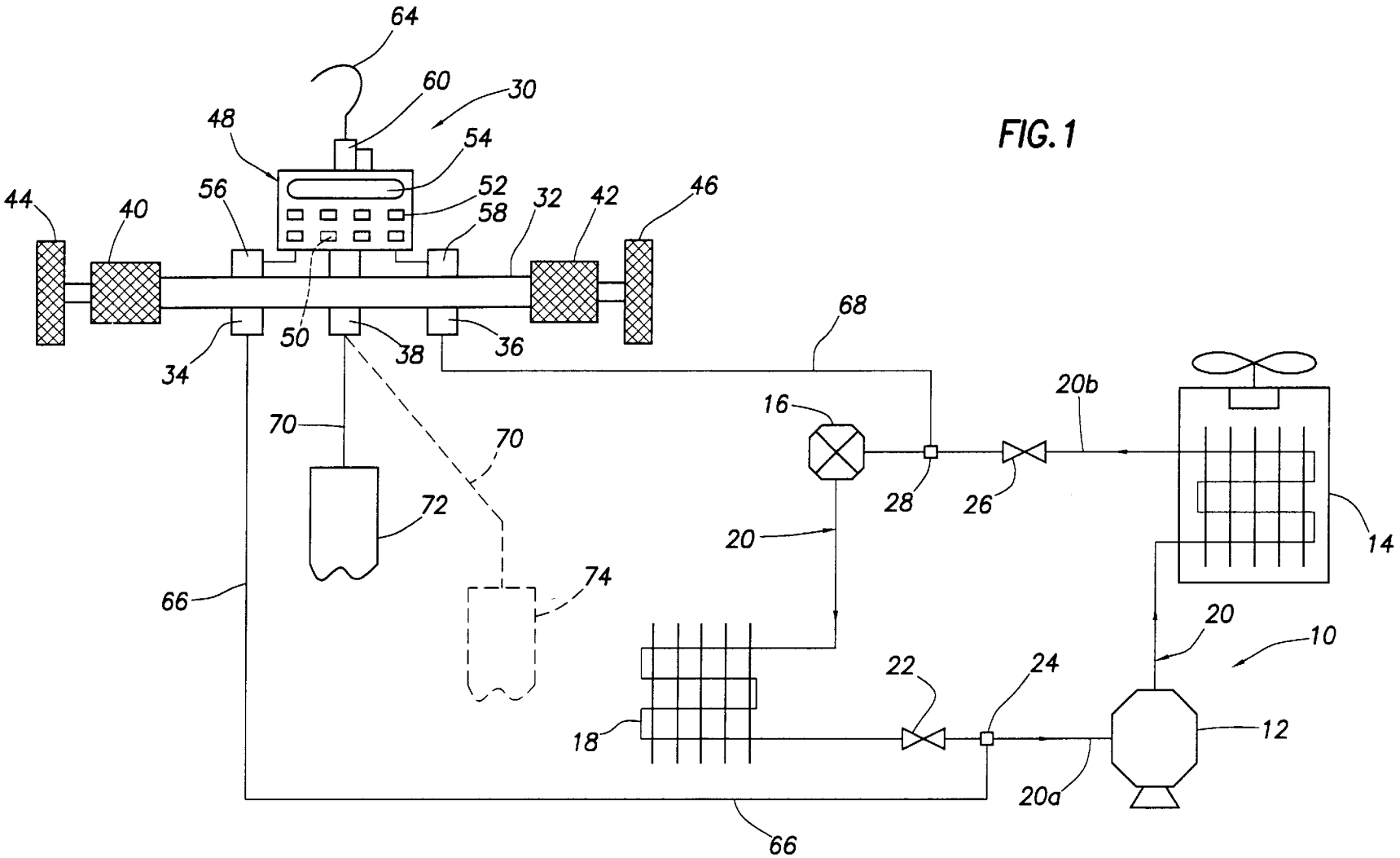
FIG. 1 is a schematic diagram of a representative air conditioning refrigerant circuit to which is operatively attached a specially designed refrigerant gauge manifold having a built-in charging calculator and embodying principles of the present invention.

Schematically depicted in FIG. 1 is a representative direct expansion type refrigerant circuit 10 used in an air conditioning system. Circuit 10 has an outside portion including a compressor 12 and a condenser 14, and an inside portion including an expansion valve 16 and an evaporator 18. These four components of the circuit 10 are operatively connected in a conventional manner by refrigerant-filled piping 20 including a suction or low pressure line portion 20*a* extending between the outlet side of the evaporator 18 and the inlet of the compressor 12, and a liquid or high pressure line portion 20*b* extending between the outlet of the condenser 14 and the expansion valve 16.

The direction of refrigerant flow through the piping 20 during operation of the circuit 10 is indicated by the arrows on the piping 20. A service valve 22 and a low side pressure tap or service fitting 24 are disposed in the suction line portion 20*a*, and a service valve 26 and a high side pressure tap or service fitting 28 are disposed in the liquid line portion 20*b*.

With continuing reference to FIG. 1, to check and adjust the refrigerant charge level of the circuit 10, a specially designed refrigerant gauge manifold 30 is provided in accordance with principles of the present invention. The refrigerant gauge manifold 30 includes a tubular body portion 32 having disposed on a longitudinally central portion thereof a suction port 34, a liquid port 36 and a refrigerant transfer port 38. Respectively mounted on the opposite ends of the manifold body 32 are conventional manifold valves 40,42 having disc-shaped handles 44,46 that may be rotated about the axis of the body 32 to selectively place their associated valves 40,42 in open and closed positions.

When valve 40 is in its open position it communicates the ports 34 and 38, and when valve 40 is in its closed position it prevents communication between the ports 34 and 38. When valve 42 is in its open position it communicates the ports 36 and 38, and when valve 42 is in its closed position it prevents communication between the ports 36 and 38.

According to a key aspect of the present invention, a specially designed battery operated charging calculator 48 is mounted on the body 32 and includes a microprocessor 50, a keyboard 52 useable to input data to the microprocessor 50, and a display window 54. Stored in the microprocessor 50 are sets of charging data for a preselected set of air conditioning systems with which the refrigerant gauge manifold 30 may be used, such data sets containing (for each system) desired relationships among the liquid pressure, suction pressure, and ambient dry bulb temperature for each system.

Pressure-to-electric transducers 56,58 are mounted on the body 32 and are operative to transmit to the microprocessor 50 electric signals respectively indicative of the refrigerant pressures at the suction and liquid ports 34,36. An ambient dry bulb temperature sensor 60 is incorporated in the gauge manifold 30 and is operative to transmit to the microprocessor 50 an electrical signal indicative of the ambient dry bulb temperature adjacent the gauge manifold 30. For convenience, a hook member 64 is provided for supporting the gauge manifold 30 on a pipe or other structure while the gauge manifold is being used.

Flexible refrigerant hoses 66,68,70 are respectively connected to the manifold ports 34,36,38. Hose 66 is removably connectable to the suction line service port 24, hose 68 is removably connectable to the liquid line service port 28, and hose 70 is selectively connectable to either a pressurized refrigerant charging canister 72 (as indicated by the solid line position of the hose 70 in FIG. 1), or a refrigerant recovery drum 74 (as indicated by the dotted line position of the hose 70 in FIG. 1). To use the refrigerant gauge manifold 30, the manifold valves 44,46 are first closed, so that neither of the ports 34,36 communicates with the port 38, and the hoses 66,68 are respectively connected to the suction and liquid line service ports 24,28 as indicated in FIG. 1.

Figure 2:
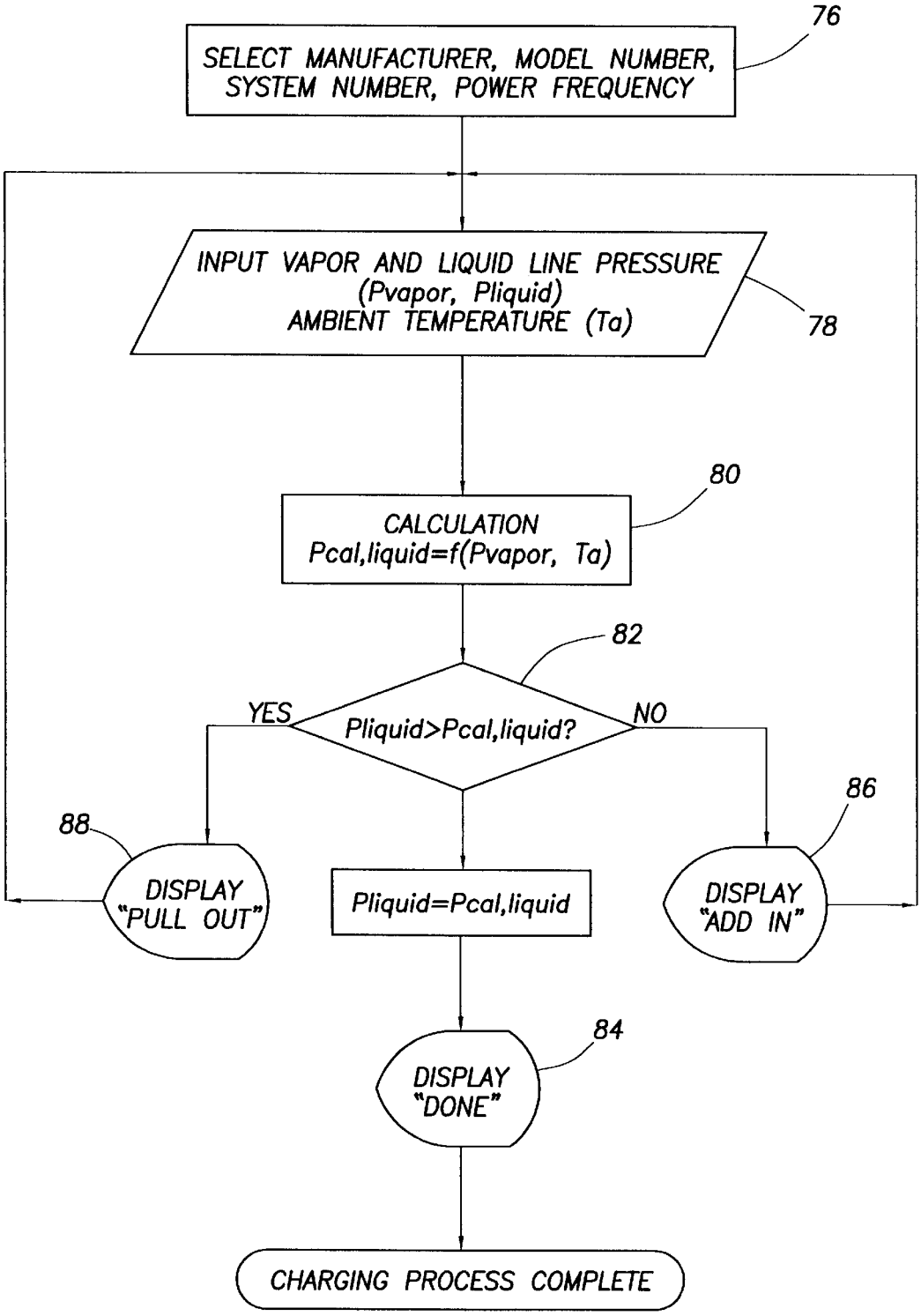
FIG. 2 is a schematic flow diagram illustrating the use and operation of the refrigerant gauge manifold schematically depicted in FIG. 1.

Referring now to FIG. 1, and to FIG. 2 which illustrates in flow chart form the use of the refrigerant gauge manifold 30, the service technician, after connecting the gauge manifold 30 to the suction and liquid line portions 20*a*,20*b* as just described carries out step 76 by using the keyboard 52 to input system identifying data to the microprocessor 50. This identifying data representatively includes the manufacturer, model number, system number and electrical power frequency for the air conditioning system being tested from a refrigerant charging level standpoint.

In addition to this system identifying data input to the calculator 48 by the service technician, the pressure-to-electric transducers 56,58 and the temperature sensor 60, as indicated at step 78, continuously transmit to the microprocessor 50 input signals respectively indicative of the sensed suction line pressure, the sensed liquid line pressure, and the sensed ambient dry bulb temperature. In response, as indicated at step 80, the microprocessor 50 calculates (for the particular system entered by the technician) a calculated value $P_{cal,liquid}$ as a function of the sensed suction line pressure $P_{vapor}$ and sensed ambient dry bulb temperature $T_a$.

Next, at step 82, the microprocessor 50 compares the sensed liquid line refrigerant pressure $P_{liquid}$ to the calculated liquid line refrigerant pressure $P_{cal,liquid}$ and determines whether the sensed liquid line refrigerant pressure $P_{liquid}$ is equal to, greater than or less than the calculated liquid line refrigerant pressure $P_{cal,liquid}$.

If the microprocessor determines at step 82 that $P_{liquid}$ is equal to $P_{cal,liquid}$, the microprocessor 50, at step 84, causes the calculator 48 to create in the display window 54 a message (such as "DONE") indicating that the circuit charge level is correct, and the charging process is completed without the necessity of adding refrigerant to or removing refrigerant from the circuit 10.

If the microprocessor 50 determines at step 82 that $P_{liquid}$ is less than $P_{cal,liquid}$, the microprocessor 50, at step 86, causes the calculator 48 to create in the display window 54 a message (such as "ADD IN") which informs the technician that the charge level in the circuit 10 is low. The technician then connects the flexible hose 70 to the pressurized refrigerant charging canister 72 (see FIG. 1) and opens the manifold valve 44 to begin to flow pressurized refrigerant into the suction line portion 20*a* of the circuit 10 sequentially through the hose 70, the ports 38 and 34, the hose 66, and the service fitting 24.

During this addition of refrigerant to the circuit 10, the microprocessor 50 cycles the program through steps 78,80, 82 and 86 so that the calculator 48 continues to display the "ADD IN" message which indicates to the technician that the circuit 10 is still undercharged. When the circuit charge level is increased to the proper level the program automatically transfers to step 84, thereby causing the calculator 48 to display "DONE". The technician then closes the manifold valve 44 and disconnects the refrigerant gauge manifold from the circuit 10 and the refrigerant recharging canister 72.

If the microprocessor 50 determines at step 82 that $P_{liquid}$ is greater than $P_{cal,liquid}$, the microprocessor 50, at step 88, causes the calculator 48 to create in the display window 54 a message (such as "PULL OUT") which informs the technician that the charge level in the circuit 10 is too high. The technician then connects the flexible hose 70 to the recovery drum 74 (see FIG. 1) and opens the manifold valve 46 to begin to flow pressurized refrigerant into the recovery drum 74 sequentially via the liquid line service fitting 28, the hose 68, the ports 36 and 38, and the hose 70.

During this removal of refrigerant from the circuit 10, the microprocessor 50 cycles the program through steps 78,80, 82 and 88 so that the calculator 48 continues to display the "PULL OUT" message which indicates to the technician that the circuit 10 is still overcharged. When the circuit charge level is decreased to the proper level the program automatically transfers to step 84, thereby causing the calculator 48 to display "DONE". The technician then closes the manifold valve 46 and disconnects the refrigerant gauge manifold from the circuit 10 and the refrigerant recovery drum 74.

The use of the refrigerant gauge manifold 30 provides a variety of advantages over conventional techniques for checking and adjusting the charge level of the circuit 10. For example, the use of its valves 44,46 and the manner in which the gauge manifold 30 is connected to and removed from the service fittings 24 and 28, the refrigerant canister 72 and the recovery drum 74 are substantially identical to the valve use and connection techniques in conventionally constructed refrigerant gauge manifolds. Additionally, the refrigerant gauge manifold 30, when programmed with the necessary identifying and charging data from various air conditioning systems and units, permits a service technician to very accurately check and adjust the charge levels of a corresponding variety of refrigerant circuits without the cumbersome location of their charging charts or tables, and with no related interpolation which can dramatically slow down the refrigerant charging level checking and adjustment task. Additionally, the usefulness of the refrigerant gauge manifold 30 may be expanded, if desired, by simply downloading identifying data and corresponding charging data into the microprocessor 50 from various additional air conditioning system manufacturers' websites.

In short, the refrigerant gauge manifold 30 substantially eliminates the guesswork in the refrigerant charging process, increases the accuracy and efficiency of the overall process, is easy and intuitive to use, and renders the entire field service process less costly. While the gauge manifold 30 has been representatively illustrated herein as being utilized in conjunction with a direct expansion type refrigerant circuit 10, it will be readily appreciated by those of skill in the refrigeration and air conditioning art that it could also be used to advantage in other types of refrigerant circuits, such as capillary type refrigerant circuits.

The foregoing detailed description is to be clearly understood as being given by way of illustration and example only, the spirit and scope of the present invention being limited solely by the appended claims.

What is claimed is:

1. Apparatus for use in determining and, if necessary, adjusting the charge level of an air conditioning system refrigerant circuit having suction and liquid line portions, said apparatus comprising:

a manifold structure including suction and liquid ports respectively communicatable with said suction and liquid lines, a refrigerant transfer port, a sensing portion operative to generate first, second and third signals respectively indicative of sensed fluid pressures at said suction and liquid lines respectively transmitted to said suction and liquid ports and sensed ambient temperature adjacent said manifold structure, and valve apparatus operative to selectively communicate said refrigerant transfer port with said suction port or said liquid port; and a charging calculator associated with said manifold structure and having a portion for storing identifying and charging data for a plurality of air conditioning systems, said charging calculator being operative to (1) receive said first, second and third signals together with system identifying data input by an operator and indicative of the circuit being tested, (2) use said first, second and third signals together with stored data associated with the received system identifying data to compute a proper refrigerant pressure level, (3) compare the computed proper refrigerant pressure level to a sensed refrigerant pressure level, (4) create a display indicative of whether the computed proper refrigerant pressure level is equal to, greater than or less than the sensed refrigerant pressure level, and (5) correspondingly change said display in response to addition of refrigerant to said circuit, or removal of refrigerant therefrom, via said fluid transfer port.

2. The apparatus of claim 1 wherein said sensing portion includes:

first and second pressure-to-electric transducers operatively coupled between said charging calculator and said suction and liquid ports, respectively.

3. The apparatus of claim 2 wherein said sensing portion further includes:

an ambient dry bulb temperature sensor operatively coupled to said charging calculator.

4. The apparatus of claim 1 wherein said sensing portion includes:

an ambient dry bulb temperature sensor operatively coupled to said charging calculator.

5. The apparatus of claim 1 wherein:

said manifold structure has an elongated body with first and second ends, and a longitudinally intermediate portion on which said suction, liquid and refrigerant transfer ports are disposed, and said valve apparatus includes first and second valves respectively mounted on said first and second ends and operatively associated with said suction, liquid and refrigerant transfer ports.

6. The apparatus of claim 1 wherein:

each of said computed proper refrigerant pressure and said sensed refrigerant pressure level is a liquid refrigerant pressure level.

7. The apparatus of claim 1 wherein:

said charging calculator has a keyboard portion for use by an operator in inputting said system identifying data.

8. Apparatus for determining and, if necessary, adjusting the charge level of an air conditioning system refrigerant circuit, said apparatus comprising:

a porting portion interconnectable between said circuit and a refrigerant vessel, said porting portion being operative to selectively transfer refrigerant in a variable direction between said circuit and said refrigerant vessel;

a valve portion for operating said porting structure;

a sensing portion for sensing ambient temperature and circuit refrigerant pressure levels and responsively generating output signals; and a calculator portion for storing identifying and charging data for a plurality of air conditioning systems, receiving said output signals and system identifying data input by an operator indicative of the circuit being tested, and responsively creating a display indicative of whether the circuit being tested is adequately charged, undercharged or overcharged.

9. The apparatus of claim 8 wherein:

said display is automatically changeable in response to variation of at least one of said output signals caused by a flow of refrigerant into or out of said circuit via said refrigerant transfer port.

10. The apparatus of claim 8 wherein said apparatus is a refrigerant gauge manifold with a built-in charging calculator.

11. The apparatus of claim 8 wherein said porting portion includes:

a suction port communicatable with a suction line portion of the circuit, a liquid port communicatable with a liquid line portion of the circuit, and a refrigerant transfer port communicatable with a refrigerant charging canister or a refrigerant recovery drum.

12. The apparatus of claim 11 wherein said valve portion includes:

a first valve operative to selectively permit and preclude a communication between said suction and refrigerant transfer ports, and a second valve operative to selectively permit and preclude communication between said liquid and refrigerant transfer ports.

13. The apparatus of claim 8 wherein:

said sensing portion is operative to sense ambient dry bulb temperature.

14. The apparatus of claim 8 wherein:

said sensing portion is operative to sense liquid and suction line refrigerant pressures in the circuit.

15. The apparatus of claim 8 wherein said sensing portion includes:

a first pressure-to-electric transducer operatively coupled between said suction port and said calculator portion, and a second pressure-to-electric transducer operatively coupled between said liquid port and said calculator portion.

* * * * *